US012557884B2

(12) United States Patent
Oliver et al.

(10) Patent No.: US 12,557,884 B2
(45) Date of Patent: Feb. 24, 2026

(54) SLIDE FASTENER

(71) Applicant: SURVITEC GROUP LIMITED, London (GB)

(72) Inventors: Paul Oliver, Rhyl (GB); Nigel Parkes, Salisbury (GB)

(73) Assignee: SURVITEC GROUP LIMITED, London (GB)

( * ) Notice: Subject to any disclaimer, the term of this patent is extended or adjusted under 35 U.S.C. 154(b) by 994 days.

(21) Appl. No.: 17/754,643

(22) PCT Filed: Oct. 7, 2020

(86) PCT No.: PCT/EP2020/078125
§ 371 (c)(1),
(2) Date: Apr. 7, 2022

(87) PCT Pub. No.: WO2021/069495
PCT Pub. Date: Apr. 15, 2021

(65) Prior Publication Data

US 2022/0240632 A1 Aug. 4, 2022

(30) Foreign Application Priority Data

Oct. 7, 2019 (GB) ..... 1914449

(51) Int. Cl.
*A44B 19/32* (2006.01)
*B63C 9/125* (2006.01)

(52) U.S. Cl.
CPC ..... *A44B 19/32* (2013.01); *B63C 9/1255* (2013.01)

(58) Field of Classification Search
CPC ..... A44B 19/32; B63C 9/1255
See application file for complete search history.

(56) References Cited

U.S. PATENT DOCUMENTS 3,340,579 A * 9/1967 Tamura ..... A44B 19/62 29/408
3,977,051 A * 8/1976 Takamatsu ..... A44B 19/384 24/404

(Continued)

FOREIGN PATENT DOCUMENTS

DE 969663 C * 11/1955 ..... A44B 19/26
DE 1011822 B 7/1957

(Continued)

OTHER PUBLICATIONS

International Search Report for International Application No. PCT/EP2020/078125 mailed Jan. 14, 2021.

(Continued)

*Primary Examiner* — S. Joseph Morano
*Assistant Examiner* — Jovon E Hayes
(74) *Attorney, Agent, or Firm* — Maschoff Brennan

(57) ABSTRACT

A slide fastener pan includes a multiplicity of sequentially arranged fastening element locations (SOB), extending from a start position (A) to an end position (B), and a fastening element (35B) at respective ones of the locations (SOB), the slide fastener part being configured for attachment to and detachment from an oppositely positioned associated slide fastener part having a multiplicity of sequentially arranged fastening elements (35A) by the movement of a sliding element (12), the attachment being by abutment of abutment portions of oppositely positioned ones of fastening elements (35A, 35B), wherein the first-mentioned multiplicity of sequentially arranged fastening element locations (30B) include a plurality of adjacent ones of the locations (30B)', between the start position (A) to the end position (B), that are modified so as to provide a region (40) between the start position and the end position at which the attached slide fastener parts are relatively easily separated. The slide fastener part carries a flexible strip (60A) that extends over (Continued)

the fastening locations (30B, 30B)' and is configured to abut a corresponding flexible strip (60A) of the oppositely positioned associated slide fastener part.

19 Claims, 6 Drawing Sheets

(56) References Cited

U.S. PATENT DOCUMENTS

| | | | | |
|---|---|---|---|---|
| 4,000,545 | A * | 1/1977 | Takamatsu | A44B 19/384 24/404 |
| 7,985,112 | B2 * | 7/2011 | Vick | B63C 9/115 441/123 |
| 9,555,866 | B2 * | 1/2017 | Oshio | B63C 9/1255 |
| 2009/0049658 | A1 * | 2/2009 | Takasawa | A44B 19/08 5/413 R |

FOREIGN PATENT DOCUMENTS

| | | | | |
|---|---|---|---|---|
| DE | 10011822 | A1 * | 9/2001 | G01N 31/16 |
| EP | 2412264 | A2 * | 2/2012 | A44B 19/32 |
| GB | 2615742 | A * | 8/2023 | A62B 17/008 |
| WO | WO-9707702 | A1 * | 3/1997 | A44B 19/26 |
| WO | WO-2014103001 | A1 * | 7/2014 | A44B 19/26 |
| WO | WO-2021069495 | A1 * | 4/2021 | B63C 9/1255 |

OTHER PUBLICATIONS

Search Report for UK Patent Application No. 1914449.2 dated Apr. 7, 2020.

* cited by examiner

SLIDE FASTENER

TECHNICAL FIELD

The present invention relates to a slide fastener part including a multiplicity of sequentially arranged fastening element locations, extending from a start position to an end position, and a fastening element at respective ones of the locations, the slide fastener part being configured for attachment to and detachment from an oppositely positioned corresponding slide fastener part having a multiplicity of sequentially arranged fastening elements by the movement of a sliding element, the attachment being by abutment of abutment portions of oppositely positioned ones of fastening elements.

The two slide fastener parts may form a zipper.

The present invention also relates to a life preserver.

BACKGROUND TO THE INVENTION

FIG. 1 shows an example inflatable lifejacket system 1. A cover 3 surrounds an inflatable lifejacket (not shown in FIG. 1). The lifejacket is wrapped in the cover 3 and the cover 3 is held closed by a zipper 5. Within the cover 3 is an inflation system, typically a compressed gas cylinder 8 with an activation device that allows the compressed gas to be released from the cylinder when an inflation handle 10 is pulled to inflate the lifejacket.

The cover 3 is generally U-shaped and is worn so that the base of the U passes behind the wearer's neck and the two legs of the U extend over opposite sides of the front of the wearer's torso. The cover 3 is held in place on the wearer by a belt 9 that passes around the wearer's waist and is fastened and unfastened by a buckle 11.

When the lifejacket is being packed into a cover 3 the deflated lifejacket is folded tightly and a zipper slider 12 is engaged onto the ends of the open zipper 5 and then as it is pulled along the zipper 5 the two sets of teeth 14A, 14B are engaged together and interlock. The slider 12 is able to close the two sets of teeth 14A, 14B together and passes over the length of the zipper 5 from A to B, as shown in FIGS. 1 and 2. The slider is drawn around the whole length of the zipper 5 and is "parked" at the end 16 of the closed zipper.

The idea of having a section of a zipper with a "weak point" is already known and is seen on lifejacket and liferaft cover zippers that have sets of teeth that are individually formed and attached to an attachment strip.

In such known arrangements, as shown in FIGS. 3 and 4, selected teeth 18A, 18B on each side of the zipper 5 are shaped so that the teeth 18A, 18B do not interlock and engage onto each other, in contrast to interlocking teeth 20A and 20B. This allows the slider 12 to pass over the section of the specially shaped teeth 18A, 18B. The selected teeth 18A, 18B provide a "weak point" in the zipper 5 where it will begin to open when inflation is commenced.

In such known arrangements, if the selected teeth 18A, 18B, that do not interlock and engage onto each other, were completely removed, then the slider 12 would not pass over that section and re-engage the teeth and would instead jam.

In such known arrangements, fluid may pass between the teeth 14A, 14B, the selected teeth 18A, 18B and/or the "weak point". The fluid could be water or air/wind. This can be disadvantageous as it allows sea water and wind to pass through the zipper, which could cause unplanned opening of the zipper or damage the deflated lifejacket.

SUMMARY OF THE INVENTION

In one aspect, the present invention provides a slide fastener part including a multiplicity of sequentially arranged fastening element locations, extending from a start position to an end position, and a fastening element at respective ones of the locations, the slide fastener part being configured for attachment to and detachment from an oppositely positioned associated slide fastener part having a multiplicity of sequentially arranged fastening elements by the movement of a sliding element, the attachment being by abutment of abutment portions of oppositely positioned ones of fastening elements, wherein the first-mentioned multiplicity of sequentially arranged fastening element locations include a plurality of adjacent ones of the locations, between the start position to the end position, that are modified so as to provide a region between the start position and the end position at which the attached slide fastener parts are relatively easily separated, characterised in that the slide fastener part carries a flexible strip that extends over the fastening locations and is configured to abut a corresponding flexible strip of the oppositely positioned associated slide fastener part.

The flexible strip may extend from the start position to the end position.

The flexible strip may be configured to co-operate with the flexible strip of the oppositely positioned associated slide fastener part to form a seal over the sequentially arranged fastening element locations.

The slide seal may tend to prevent or reduce the passage of fluid between the slide fastener parts.

The slide fastener part may include a reinforcing strip or stringer, wherein the flexible strip has a proximal end attached to the reinforcing strip or stringer.

Selected ones of the fastening elements may have an abutment portion, and wherein the abutment portion is omitted at the plurality of adjacent ones of the locations that are modified.

At the fastening element locations at which an abutment portion is omitted, the fastening element may be wholly or partially omitted.

The slide fastener part may comprise one side of a zipper.

The two slide fastener parts may form a zipper.

Some or all of adjacent ones of the fastening elements may be (directly) connected together. Some or all of adjacent ones of the fastening elements may be formed as a single part. The slide fastener part may comprise one side of a coil zipper. The coil zipper may include a filament coil having a plurality of convolutions extending around a coil axis with each convolution being one of said fastening elements, wherein a plurality of said convolutions is wholly or partially omitted at said region.

The slide fastener part may be a life preserver slide fastener part.

In another aspect, the present invention provides a slide fastener including the slide fastener part recited above and the oppositely positioned associated slide fastener part recited above.

Each of the slide fastener parts may carry a flexible strip, the two flexible strips meeting to create a seal.

In a further aspect, the present invention provides a life preserver system including a cover, an inflatable life preserver unit housed within the cover, and a slide fastener as recited above arranged to close an opening in the cover, wherein the inflatable life preserver unit is released from the opening of the cover by separation of the slide fastener parts at said relatively easily separated region.

The life preserver system may include inflation means for inflating the inflatable life preserver unit, the arrangement being such that the inflation of the life preserver unit causes the separation of the slide fastener parts at said relatively easily separated region.

The is also provided a slide fastener part including a multiplicity of sequentially arranged fastening element locations, extending from a start position to an end position, and a fastening element at respective ones of the locations, selected ones of the fastening elements having an abutment portion, the slide fastener part being configured for attachment to and detachment from an oppositely positioned associated slide fastener part having a multiplicity of sequentially arranged fastening elements by the movement of a sliding element, the attachment being by abutment of abutment portions of oppositely positioned ones of fastening elements, wherein the first-mentioned multiplicity of sequentially arranged fastening element locations include a plurality of adjacent ones of the locations, between the start position to the end position, at which an abutment portion is omitted so as to provide a region between the start position and the end position at which the attached slide fastener parts are relatively easily separated.

The embodiment to be described provides a means of a cover that surrounds an inflatable safety device (inflatable lifejacket or life raft, etc.) when it is deflated but upon the inflation system being activated, the cover opens in a controlled manner. The embodiment provides a zipper that holds the protective cover closed but when inflation is commenced the zipper begins to burst open at a given "point of weakness" where there is an absence of "teeth" connecting the two halves of the zipper together.

In contrast to the embodiment, the known zippers described above have sets of teeth that are individually formed and attached to an attachment strip (unlike a spirally wound or coil zipper).

In contrast to the embodiment, the known zippers described above have selected teeth are shaped so that the teeth do not interlock and engage onto each other (rather than omitted teeth).

In contrast to the embodiment, the absence of the flexible strips in the known zippers can result in premature bursting open of the zipper or in fluid passing through the zipper.

BRIEF DESCRIPTION OF THE DRAWINGS

For a better understanding of the present invention an embodiment will now be described by way of example, with reference to the accompanying drawings, in which.

In the drawings like elements of generally designated with the same reference signs.

DETAILED DESCRIPTION OF EMBODIMENT OF THE INVENTION

Figure 1:
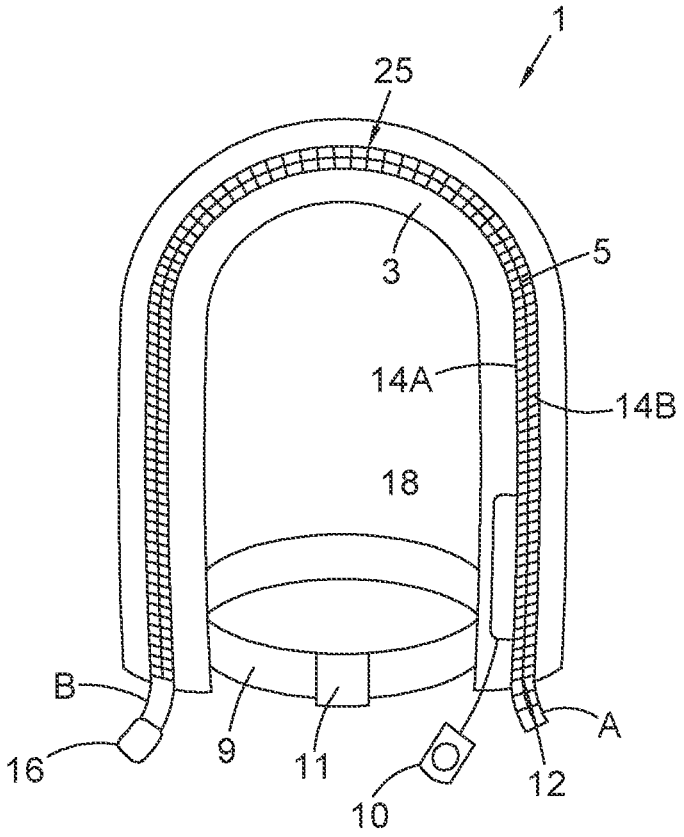
FIG. 1 shows a front elevational view of a life preserver system.
Figure 2:
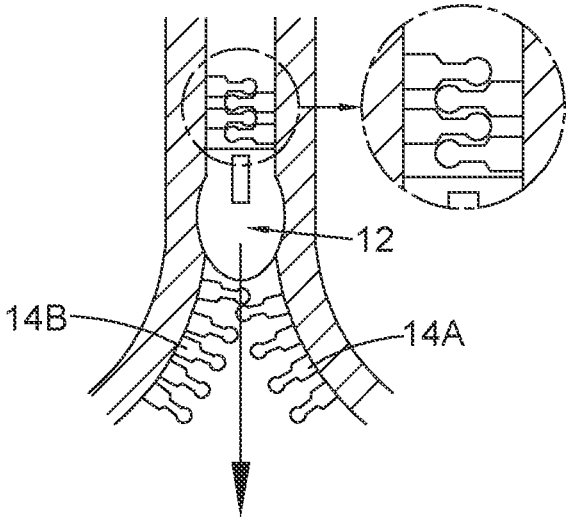
FIG. 2 shows a more detailed view of a known zipper arrangement for closing the cover of the life preserver system.
Figure 3:
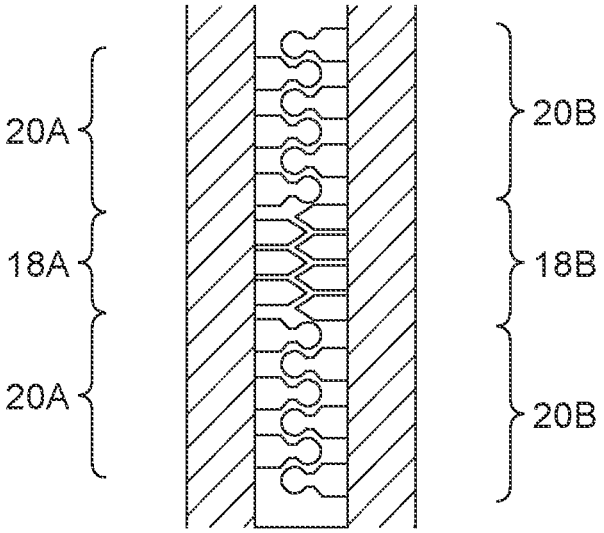
FIG. 3 shows the configuration of teeth of a known zipper arrangement in order to form a weak point to allow the zipper to burst open on inflation of an inflatable lifejacket within the cover.
Figure 4:
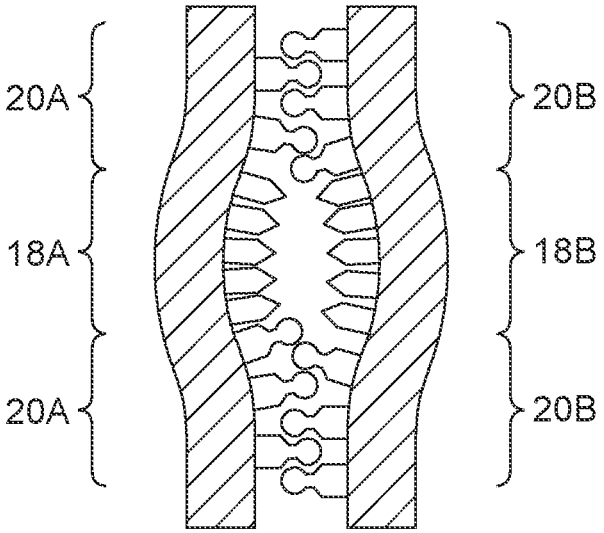
FIG. 4 shows the zipper of FIG. 3 with the opposite sides of the zipper open at the weak point by inflation of the lifejacket.

A life preserver system according to an embodiment of the invention has the same general form as shown in FIG. 1, with the U-shaped cover 3 that surrounds an inflatable lifejacket, as described above. The inflatable lifejacket is inflated by an inflation system, as described above, in order to provide buoyancy for the wearer in an emergency situation, e.g. on water.

According to the embodiment of the invention to be described, the zipper 5 of the known type described above is replaced with a new and advantageous zipper 5' arrangement, as shown in FIGS. 5 to 11.

Figure 5:
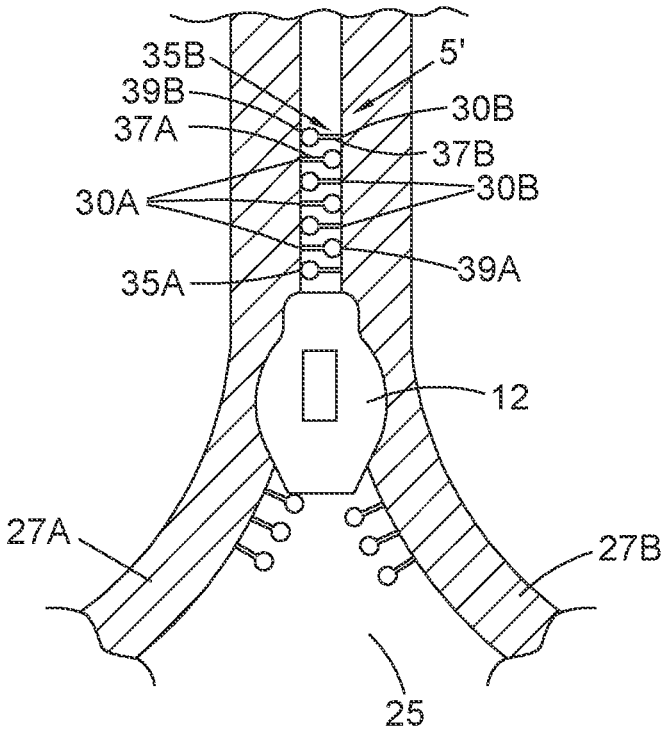
FIG. 5 shows a zipper in accordance with an embodiment of the present invention.
Figure 6:
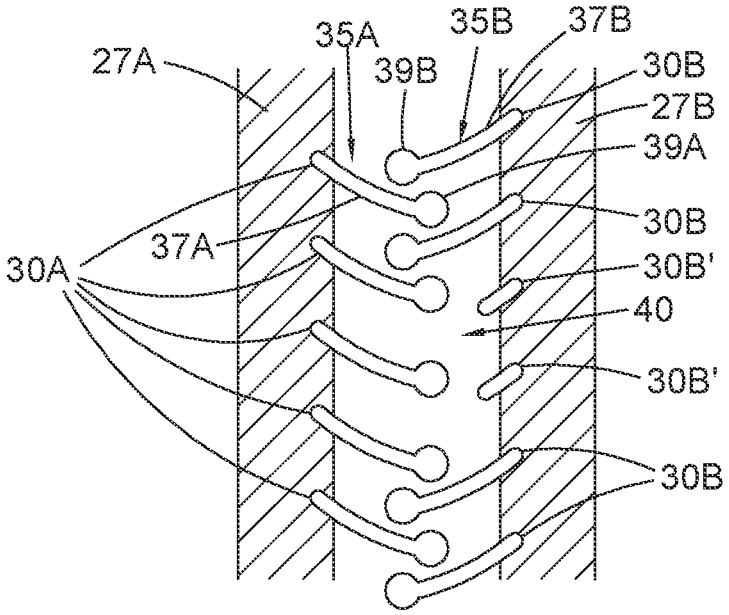
FIG. 6 shows the arrangement of the zipper of the present embodiment at a weak point thereof.
Figure 7:
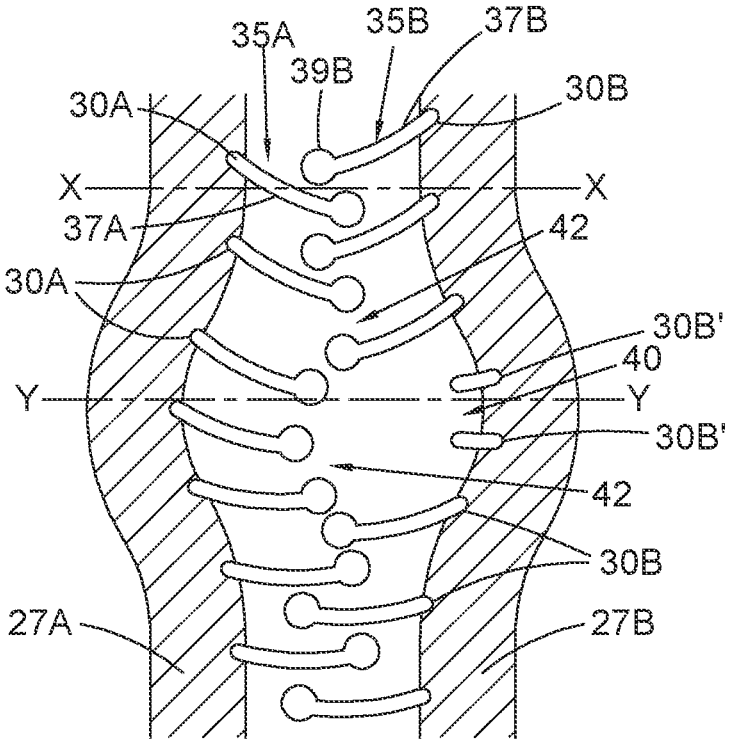
FIG. 7 shows the zipper of FIG. 6 with opposite sides of the zipper forced apart by inflation of the inflatable lifejacket within the case.

The cover 3 has a U-shaped opening 25 that is closed by the zipper 5'. The invention is of course applicable to other opening shapes. FIGS. 5, 6 and 7 show just a part of the zipper 5'. In the embodiment to be described, the zipper 5' has U-shape corresponding to that of the opening 25. The opening 25 has two reinforcing strips (or stringers) 27A, 27B extending around its periphery, as best shown in FIGS. 5, 6 and 7. The reinforcing strips 27A, 27B carry the teeth of the zipper 5' and thereby attach the teeth to the cover 3. In the example, the first reinforcing strip 27A extends around the outside of the U-shape of the opening 25, from a start position A of the opening 25 to an end position B of the opening 25, and the second reinforcing strip 27B extends around the inside of the U-shape of the opening 25, from a start position A of the opening 25 to an end position B of the opening 25.

The cover may have more than one opening, each being closed by a zipper like the zipper 5' (but having a shape corresponding to the opening).

The zipper 5' may be a coil zipper including a filament coil having a plurality of convolutions extending around a coil axis, with each convolution being one tooth.

In a coil zipper, a coiled filament is woven to the respective reinforcing strips 27A, 27B. The reinforcing strips 27A, 27B may have warp threads and filler threads interwoven with cords and these cords serve to strengthen the reinforcing strips 27A, 27B for the coiled filaments.

Each convolution of each filament is provided with a central projecting head portion of the convolution. The projecting head portions may be generally cylindrical but rounded at their ends to facilitate simplified interlocking with each other. Thus, the generally cylindrical projecting head portions may have axes parallel to the coil axis around which each coil extends. Each projecting head portion of generally cylindrical configuration may be of a substantially constant diameter except for the free end region thereof which is rounded. Although in the embodiment, the projecting head portions are generally cylindrical, other shapes are possible.

A lower projecting head portion on a turn in one filament may mate and interlock with an upper projecting head portion on the cooperating turn of the opposite filament. Furthermore, each turn of either one filament is sandwiched between two adjacent turns of the opposite filament.

Each convolution is a tooth of the zipper. The form of the teeth is shown in FIGS. 5, 6 and 7. The zipper 5' comprises a multiplicity of sequentially arranged tooth locations 30A, 30B on the reinforcing strips 27A, 27B extending along opposite sides of the opening 25. The tooth locations 30A, 30B extend from a start position A of the opening 25 to an end position B of the opening 25. A tooth 35A is provided at each of respective ones of the tooth locations 30A on a first side of the opening 25, and, similarly, a tooth 35B is provided at each of respective ones of the tooth locations 30B on the opposite side of the opening 25.

Each of the teeth 35A, 35B includes a stem portion 37A, 37B that is attached to the reinforcing strip 27A, 27B at a proximal end, with a relatively large head portion 39A, 39B at the distil end of the stem 37A, 37B.

The zipper slider 12 is engaged onto the ends of the open zipper 5'. As the slider 12 is pulled along the zipper 5', the two opposites sets of teeth 35A, 35B are pulled together so that they engage together and interlock, as shown in FIG. 5. The interlocking is caused by portions of the teeth 35A, 35B (abutment portions) being locked together by the reinforcement strips 27A, 27B on opposites sides of the opening 25 being drawn to drawn together by the slider 12. As shown in FIG. 5, the head portion 39B of one of the teeth 35B on one side of the opening 25 passes between the head portions 39A of two adjacent teeth 30A on the opposite side of the opening 25 and may abut the stem portions 27A of those teeth 35A.

As shown in FIGS. 6 and 7, at a plurality (e.g. 3 or 4) of selected adjacent ones 30B' of the tooth locations 30B abutment portions of the teeth 35B are omitted on one side (only) of the zipper 5' so is to provide a region 40 between the start position A and the end position B of the zipper 5' at which the opposite sides of the zipper 5' are relatively easily separated.

The abutment portions may be omitted by omitting the head portion 39B and, optionally, all or part of the stem portion 37A.

The slider 12 is able to close the opposite sets of teeth 35A, 35B of the zipper together and pass over the region 40 of the zipper 5' where the zipper teeth are missing. The zipper 5' is closed in substantially the conventional way. However, the region 40 of the zipper 5' where the abutment portions of the teeth are omitted provides a "weak point" of the zipper 5'. The slider 12 continues to be drawn around the length of the zipper 5' opening 25 and is parked at the end 16 of the closed zipper 5'.

The slider 12 of the embodiment may be sized so that its length in the direction of travel of the slider along the teeth is equal to or greater that the length of the region 40 in the same direction. The slider may be sized to bridge across the region 40.

The arrangement of the zipper 5' is such that, when the lifejacket is uninflated inside the cover 3, the zipper 5' remains closed and the inflatable lifejacket is held securely in, and protected by, the cover 3. When inflation of the inflatable lifejacket occurs, this exerts a pressure on the zipper 5'. This pressure forces the opposite sides of the zipper 5' apart at the region 40 of the weak point, as shown in FIG. 7.

Figure 8:
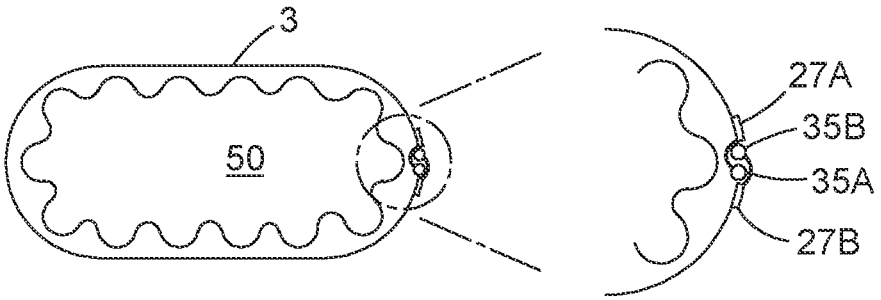
FIG. 8 shows a cross section of a lifejacket taken along line X-X of FIG. 7, with the encircled region shown enlarged.
Figure 9:
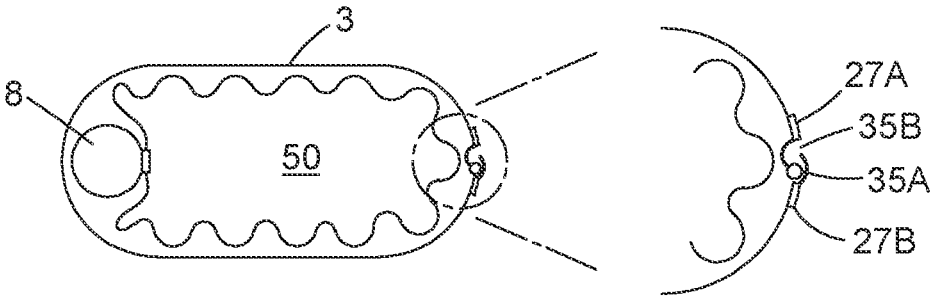
FIG. 9 shows a cross section taken along line Y-Y of FIG. 7, with the encircled region shown enlarged.

FIG. 8 shows a cross section of the lifejacket system, including along line X-X of FIG. 7, where the teeth 35A, 35B have their abutment portions. In FIG. 8 the inflatable lifejacket 50 is shown in its uninflated state inside the case 3. FIG. 9 shows a cross section of the lifejacket system, including along line Y-Y of FIG. 7, where the teeth 35A, 35B have their abutment portions omitted.

Figure 10:
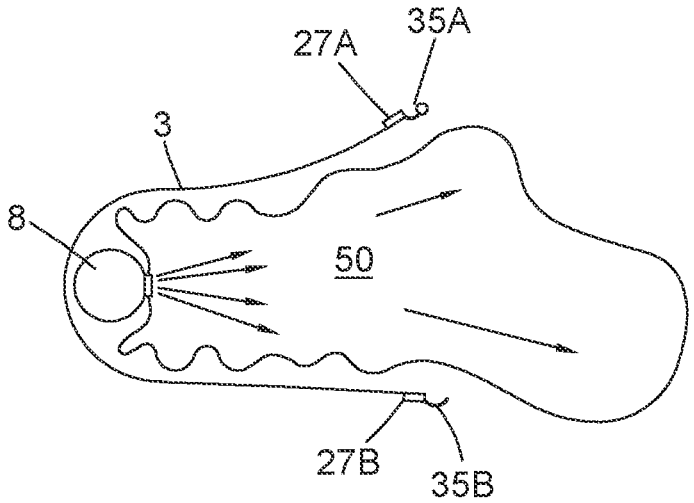
FIG. 10 shows a cross section corresponding to that of FIG. 9 after further inflation of the inflatable lifejacket.

When the inflatable lifejacket 50 is partially inflated, the pressure exerted by the inflation begins to open the zipper 5' at the weak point at region 40. As pressure continues to be applied by inflation of the lifejacket 50, the movement apart of the opposite sides the opening 25 at the weak point at region 40 cause the teeth 35A, 35B adjacent to weak point at region 40 to disengage from one another so the abutment portions no longer abut the opposite teeth, as shown at 42 in FIG. 7. The disengagement of the teeth 35A, 35B, continues to spread up and down the opening 25 away from the weak point at region 40 so that the opening 25 may be fully or partially opened and the lifejacket 50 released from the cover 3, as shown in FIG. 10.

Although the weak point at region 40 allows the inflatable lifejacket 50 to be released when it is inflated, when the zipper 5' is closed by the slider 12, the cover 3 will generally not be opened by wind or air blast, for example when a pilot ejects from a fast jet travelling at speed, despite the presence of the weak point.

As mentioned above, an inflation system, typically a compressed gas cylinder 8, is provided in the cover 3. An inflation gas outlet may be located at or near the region 40. Such an arrangement results in the inflation gas opening the region 40 earlier that would be the case if the outlet were further away from the region 40.

A tab or handle (not shown) may be provided at or near the region 40 to allow a user to manually pull apart the cover 3 at the region 40. A pair of tabs or handles may be provided, one of each pair being on opposite sides of the region 40. The tab or tabs may allow the user to augment the action of the inflation gas. If the inflation system 8 fails, the tab or tabs allow the user to open the cover at the region 40 in the absence of any inflation pressure from the inflation system 8; and the life jacket 50 may then be inflated manually (orally, by an oral inflation tube).

Figure 11A:
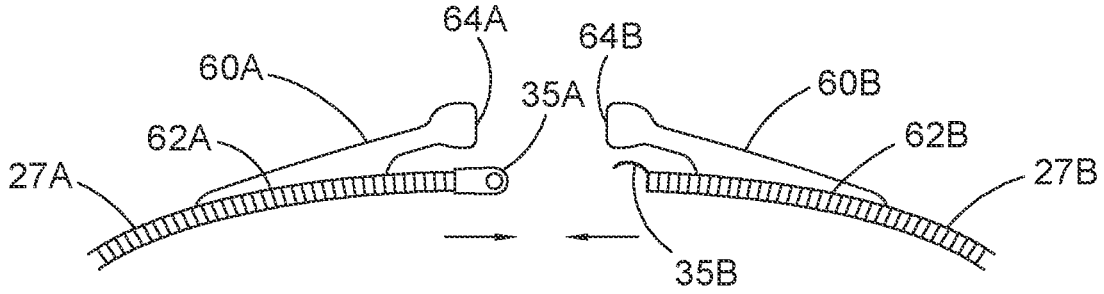
FIGS. 11A and 11B show a cross sectional view of an arrangement of the zipper of the embodiment in which additional flexible strips are provided over the zip to prevent foreign bodies, air and/or water from entering the cover through the zipper.
Figure 11B:
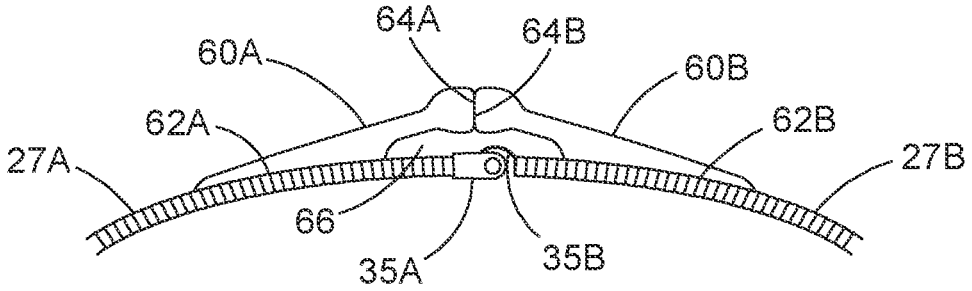

FIGS. 11A and 11B show an advantageous feature of the zipper 5', where each reinforcing strip 27A, 27B carries a flexible strip 60A, 60B along its length, preferably along substantially the entire length of each reinforcing strips 27A, 27B—from a start position A of the opening 25 to an end position B of the opening 25.

The flexible strip 60A may have a proximal end 62A attached to the associated reinforcing strip 27A and a distal end 62B that extends over the associated reinforcing strip 27A and towards the opposite reinforcing strip 27B. The flexible strip 60B may have a proximal end 62B attached to the associated reinforcing strip 27B and a distal end 64B that extends over the associated reinforcing strip 27B and towards the opposite reinforcing strip 27A. The distal ends 64A, 64B of the flexible strips 60A, 60B abut each other when the zipper 5' is closed (as shown in FIG. 11B), generally above the centre of zipper 5' (although, optionally, the abutment may be to one or other side of the zipper 5'). A space 66 may be defined between the abutting flexible strips 60A, 60B and the zipper 5'.

The flexible strips 60A, 60B may have a proximal end 62A, 62B attached to their associated reinforcing strip 27A, 27B and a distal end 64A, 64B that extends over the teeth 35A, 35B of the associated reinforcing strip 27A, 27B, with distal ends 64A, 64B of the reinforcing strips 60A, 60B abutting each other when the zipper 5' is closed (as shown in FIG. 11B), generally above the centre of zipper 5' (although, optionally, the abutment may be to one or other side of the zipper 5').

The flexible strips 60A, 60B may be formed of rubber or plastics, for example, and are sufficiently rigid and elastically deformable so that when the slider 12 brings the two sides of the zipper 5' together, the two distal ends of the flexible strips 60A, 60B are brought together tightly to form a seal that protects the inside of the cover 3 from water, sand, dust and the like entering the cover 3 through the zipper 5' and damaging the lifejacket 50 inside. The flexible strips 60A, 60B may also provide additional protection against windblast on ejection from an aircraft or submersion at sea.

It should be understood that the zipper 5' may be used in other applications to that described. The applications include non-life preserver applications. The cover closed by the zipper 5' may be any shape, e.g. rectangular or cuboid, and the U-shape described is just one example. The inflatable device in the cover could be any inflatable device, and not necessarily a lifejacket. The inflatable device may be a liferaft.

The invention claimed is:

1. A slide fastener part including:

a first multiplicity of sequentially arranged fastening element locations, extending from a start position to an end position, and a first multiplicity of sequentially arranged fastening elements, each fastening element arranged at a respective one of the locations, the slide fastener part being configured for attachment to and detachment from an oppositely positioned associated slide fastener part having a second multiplicity of sequentially arranged fastening elements by the movement of a sliding element, the attachment being by abutment of abutment portions of oppositely positioned ones of first and second multiplicities of fastening elements, wherein the first multiplicity of sequentially arranged fastening element locations include a plurality of adjacent ones of the locations, between the start position to the end position, that are modified so as to provide a region between the start position and the end position at which the attached slide fastener parts are relatively easily separated, and wherein the slide fastener part carries a flexible strip that extends over the first fastening element locations and is configured to abut a corresponding flexible strip of the oppositely positioned associated slide fastener part.

2. The slide fastener part of claim 1, wherein the flexible strip extends from the start position to the end position.

3. The slide fastener part of claim 1, wherein the flexible strip is configured to co-operate with the flexible strip of the oppositely positioned associated slide fastener part to form a seal over the first sequentially arranged fastening element locations.

4. The slide fastener part of claim 3, wherein the seal is configured to reduce the passage of fluid between the slide fastener parts.

5. The slide fastener part of claim 1, further comprising a reinforcing strip or stringer, wherein the flexible strip has a proximal end attached to the reinforcing strip or stringer.

6. The slide fastener part of claim 1, wherein selected ones of the first fastening elements have an abutment portion, and wherein the abutment portion is omitted at the plurality of adjacent ones of the locations that are modified.

7. The slide fastener part of claim 1, wherein, at the fastening element locations at which an abutment portion is omitted, the fastening element is wholly or partially omitted.

8. The slide fastener part of claim 1, comprising one side of a zipper.

9. The slide fastener part of claim 1, wherein some or all of adjacent ones of the first fastening elements are connected together and/or are formed as a single part.

10. The slide fastener part of claim 1, comprising one side of a coil zipper.

11. The slide fastener part of claim 10, the coil zipper including a filament coil having a plurality of convolutions extending around a coil axis with each convolution being one of said first fastening elements, wherein a plurality of said convolutions is wholly or partially omitted at said region.

12. The slide fastener part of claim 1, in combination with the sliding element, wherein the sliding element is sized to bridge said plurality of adjacent ones of the locations at which an abutment portion is omitted.

13. A slide fastener including:

a sliding element, a first slide fastener part including:

a first multiplicity of sequentially arranged fastening element locations, extending from a start position to an end position, and a first multiplicity of sequentially arranged fastening elements, each first fastening element arranged at a respective one of the locations, a second slide fastener part positioned opposite the first slide fastener part and including:

a second multiplicity of sequentially arranged fastening element locations, extending from the start position to the end position, and a second multiplicity of sequentially arranged fastening elements, each second fastening element arranged at a respective one of the locations, the first slide fastener part being configured for attachment to and detachment from the second slide fastener part by the movement of the sliding element, the attachment being by abutment of abutment portions of oppositely positioned ones of first and second multiplicities of fastening elements, wherein the first multiplicity of sequentially arranged fastening element locations include a plurality of adjacent ones of the locations, between the start position to the end position, that are modified so as to provide a region between the start position and the end position at which the attached first and second slide fastener parts are relatively easily separated, and wherein the first slide fastener part carries a first flexible strip that extends over the first fastening locations, the second slide fastener part carries a second flexible strip that extends over the second fastening locations, and the first and second flexible strips are configured to abut.

14. The slide fastener of claim 13, wherein the distal ends of the first and second flexible strips abut over the first and second slide fastener parts.

15. A life preserver system including a cover, an inflatable life preserver unit housed within the cover, and a slide fastener according to claim 13 arranged to close an opening in the cover, wherein the inflatable life preserver unit is released from the opening of the cover by separation of the first and second slide fastener parts at said region.

16. The life preserver system of claim 15, wherein the first and second flexible strips extend along opposite sides of the opening and are configured to abut one another when the opening is closed to prevent or reduce fluid passing through the opening.

17. The life preserver system of claim 15, including inflation means for inflating the inflatable life preserver unit, the arrangement being such that the inflation of the life preserver unit causes the separation of the first and second slide fastener parts at said region.

18. The life preserver system of claim 15, including at least one manually grippable part coupled to said cover at or near said region for facilitating manual separation of the first and second slide fastener parts at said region.

19. The slide fastener of claim 14, wherein the first and second slide fastener parts define a space between the first and second flexible strips and the first and second slide fastener parts.

* * * * *